US011246361B1

(12) United States Patent
Wimer-Golebiowski

(10) Patent No.: US 11,246,361 B1
(45) Date of Patent: Feb. 15, 2022

(54) SMOOTHING AND ENHANCING LOWER GARMENT

(71) Applicant: Tamara Wimer-Golebiowski, Las Vegas, NV (US)

(72) Inventor: Tamara Wimer-Golebiowski, Las Vegas, NV (US)

( * ) Notice: Subject to any disclaimer, the term of this patent is extended or adjusted under 35 U.S.C. 154(b) by 0 days.

(21) Appl. No.: 17/384,634

(22) Filed: Jul. 23, 2021

(51) Int. Cl.
*A41D 1/22* (2018.01)
*A41D 27/26* (2006.01)
*A41D 1/06* (2006.01)

(52) U.S. Cl.
CPC ..... *A41D 27/26* (2013.01); *A41D 1/06* (2013.01); *A41D 2400/38* (2013.01)

(58) Field of Classification Search
CPC combination set(s) only.
See application file for complete search history.

(56) References Cited

U.S. PATENT DOCUMENTS 2,318,199 A * 5/1943 Clements ..... A41D 1/088 2/407
4,488,317 A * 12/1984 Polsky ..... A41D 1/06 2/227
5,103,505 A * 4/1992 Llorens ..... A41D 13/0537 2/228
5,271,101 A * 12/1993 Speth ..... A41D 1/084 2/214
7,950,069 B2 5/2011 Lee
9,572,379 B2 2/2017 Jones
9,775,386 B2 10/2017 Forsythe
10,058,131 B2 8/2018 Solano et al.
11,096,430 B2 * 8/2021 Otashevich ..... A41D 1/06
2004/0194193 A1 10/2004 Hart
2009/0139015 A1 * 6/2009 Meyer ..... A41D 1/088 2/455
2013/0125293 A1 * 5/2013 Stearns ..... A41D 31/125 2/227
2014/0273742 A1 9/2014 Hays et al.
2015/0164151 A1 6/2015 James
2015/0208733 A1 7/2015 James
2016/0120248 A1 * 5/2016 Oliver ..... A41B 9/004 2/69
2017/0156410 A1 6/2017 Yuen
2017/0318864 A1 11/2017 Carroll et al.
2020/0260805 A1 * 8/2020 Ovington ..... A41D 13/0017
2020/0337387 A1 10/2020 Weirtz et al.
2020/0375273 A1 * 12/2020 Otashevich ..... A41D 1/06

* cited by examiner

*Primary Examiner* — Tajash D Patel
(74) *Attorney, Agent, or Firm* — Quickpatents, LLC; Kevin Prince

(57) ABSTRACT

A lower garment for a female person includes an interior layer that comprises one or more elastic fabric panels encircling the person's waist and at least a portion of the person's stomach. The interior layer extends downward to at least the top of the person's upper thighs around the person's legs. The interior layer has an inside surface for contacting the person's skin, and an outside surface. A resilient crotch insert extends from an inseam of the interior layer forward to substantially cover the person's labia and is adapted to present a smooth front surface. An exterior layer is applied to the outside surface of the interior layer and the front surface of the crotch insert. The interior layer may include two buttocks pocket openings that each define a buttocks pocket adapted for receiving a resilient shaping insert that covers at least a portion of the person's buttocks.

19 Claims, 7 Drawing Sheets

SMOOTHING AND ENHANCING LOWER GARMENT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to lower garments, and more particularly to a lower garment with smoothing and feature enhancing features.

BACKGROUND

Form-fitting women's lower garments, such as leggings, tights, and even jeans, have many drawbacks. One principal embarrassment is that tight fitting lower garments often imprint the shape of the woman's labia. Clothes worn during exercising, which are typically tight and form-fitting, are notoriously susceptible to this, making the wearer self-conscious and inhibited during exercise. Wearing a large menstrual pad does little to reduce the embarrassment since such an item is also clearly visible to observers.

Another drawback for those wearing shapewear under such lower garments is that the seams and bulges are also obvious through tight-fitting outer garments. Typical shapewear is not specifically designed for the clothing one might be wearing. Women feel forced to layer their shapewear, resulting in two, three, four or more shapewear components for different problem areas or for smoothing out the seams and edge lines associated with them. Even so, odd looking bulges can be evident when layering multiple shapewear and other garments. Gusset crotch lines (originally a 13th century French design for men in combat) that are sewn into nearly all garments and shapewear, can be seen with the naked eye and appear like a giant menstrual pad in the crotch area, evident while even walking and certainly while exercising.

Shapeware often results in "booty circle marks" and often a wedgy, resulting in raw skin from thick G-string shapewear, also giving the wearer a pancake or a tear drop shaped buttocks. When buttocks shapewear is worn, sometimes one shapewear pad will slip below the other, resulting in an asymmetric look. Buttocks and crotch padding often also migrates or slips, particularly with shaping pads that are too small, resulting in the shaping pads showing through, falling out, or sliding down the back of one's pant leg. A flat buttocks can result due to over compression, resulting in insufficient definition in the buttocks region. Some buttocks shapeware pulls the buttocks up, but result in extreme tightness in the front and enhance labia imprinting on the front of the garment. Seams and edge lines or indentations between legs can be overly emphasized in traditional shapewear. Apertures designed in the crotch region, so that one can use the bathroom, often flap around and pinch skin, forcing the material out through the inseam to become embarrassingly observable. This creates heavy lines especially in the back regions which nearly always show through tight fitting attire.

Traditional shapewear often results in heavy side or inner thigh seam lines, ripples, lace indentations, squeeze marks, sweat marks, visible creases, deformations, and visible underwear edge lines. Some shapewear is cut at odd places, making the elastic material emphasize and actually drawing attention to fat or skin in the hamstring area in tight fitting clothing.

Such prior art shapewear is often made from thin material which does not help with smoothing or concealing cellulite, and can actually increase cellulite due to squeezing. Bodysuits with oddly designed straps cannot be worn with a standard tank top and are too long to wear with a sports bra (that is, such garments are typically not fashionably designed, look very unsexy and more like lederhosen. Often thick straps of such garments poke out of one's tank top or upper garment.

Corsets often show boning, zipper or hooks through any material. Waist shapers frequently pinch skin and create an upper back skin/fat bulge. Such garments result in a waistline that always rolls down whenever the wearer moves, sits or stands up. Often such garments are non-squat proof or made of a transparent material.

Crotch guard inserts of the prior art frequently end up on the floor, in the toilet or migrating down the pant leg. Buttocks-lifting band marks show through virtually any tight material and leave one's skin indented for hours after wearing. Hamstring skin ripples or fat indentations can appear, as well as front mid-thigh pinched skin lines. Shapewear that rolls up the leg is another prior art drawback, particularly when getting dressed. Lines that cut at the buttocks for waist and stomach region shapewear are often overtly visible. Such prior art is often made of a polyester fabric which absorbs sweat, resulting in an unpleasant odor. Present day shapewear might be well-suited for older generations, but little is available that is sexy or hip for the younger generation of women seeking something that gives them a nice buttocks shape without lines, no labia impression, no gusset, something fashionable, with style, easy to wear and all in one garment.

Present day shapewear might be well-suited for older generations, but little is available that is attractive and fashionable for the younger generation of women seeking something that gives them a nice buttocks shape without lines, no labia impression, no gusset, something fashionable, with style, easy to wear and all in one garment. The present invention accomplishes these objectives.

SUMMARY OF THE INVENTION

The present invention is a lower garment for a female person. The lower garment may take the form of, for example, shorts, leggings, capris, jeans, biker shorts, sweat patents, tights, or any other suitable lower garment. An interior layer comprises one or more elastic fabric panels encircling the person's waist and at least a portion of the person's stomach at a top end of the interior layer. The interior layer extends downward to at least the top of the person's upper thighs around the person's legs. The interior layer has an inside surface for contacting the person's skin, and an outside surface.

A resilient crotch insert extends from an inseam of the interior layer forward to substantially cover the person's labia. The crotch insert is adapted to present a smooth front surface that does not conform to the shape of the person's labia when worn.

An exterior layer is applied to the outside surface of the interior layer and the front surface of the crotch insert. The exterior layer is preferably integrally formed without seams in preferred embodiments. Together the exterior layer presents a seamless or minimally-seamed garment outwardly, obscuring the crotch insert and any seams that may be present with the interior layer.

Preferably the interior layer and the exterior layer together are adapted to compress the person's thighs and to lift and support the person's buttocks. In some embodiments the interior layer and the exterior layer together are adapted to lift and support at least the portion of the person's stomach.

In some embodiments a high-friction strip is disposed around the inside surface of the interior layer proximate the top end of the interior layer. As such, the high-friction strip inhibits slipping of the lower garment on the person's waist.

In some embodiments the interior layer extends to at least the person's mid-thighs down each of the person's legs. The interior layer extending down each leg is preferably made of a single seamless fabric panel to avoid unsightly seams.

In preferred embodiments of the invention, the interior layer includes two buttocks pocket openings through the interior layer proximate the top end of the interior layer at a back side thereof. Each pocket opening defines a buttocks pocket adapted for receiving a shaping insert between the interior layer and a pocket panel. The shaped insert extends downward to cover at least a portion of the person's buttocks, and preferably includes a foam or silicon material adapted to retain its shape but still be resilient.

In such embodiments, each pocket opening preferably includes a closure on the inside surface of the interior garment. Each closure has an open configuration and a closed configuration, such that the shaping insert is inhibited from slipping within the buttocks pocket when the closure is in the closed configuration. Preferably, however, the closure is relatively flat when in the closed configuration so that little or no outline of the closure is visible through the internal layer and the external layer of the lower garment.

The present invention provides an attractive and fashionable lower garment for the younger generation of women seeking something that gives them a nice buttocks shape without lines, no labia impression, no gusset, something fashionable, with style, easy to wear and all in one garment. Such a needed garment can be applied to various styles of lower garments, such as leggings, tights, shorts, and the like. The needed invention provides options for using shaping inserts of various shapes and sizes, or not. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
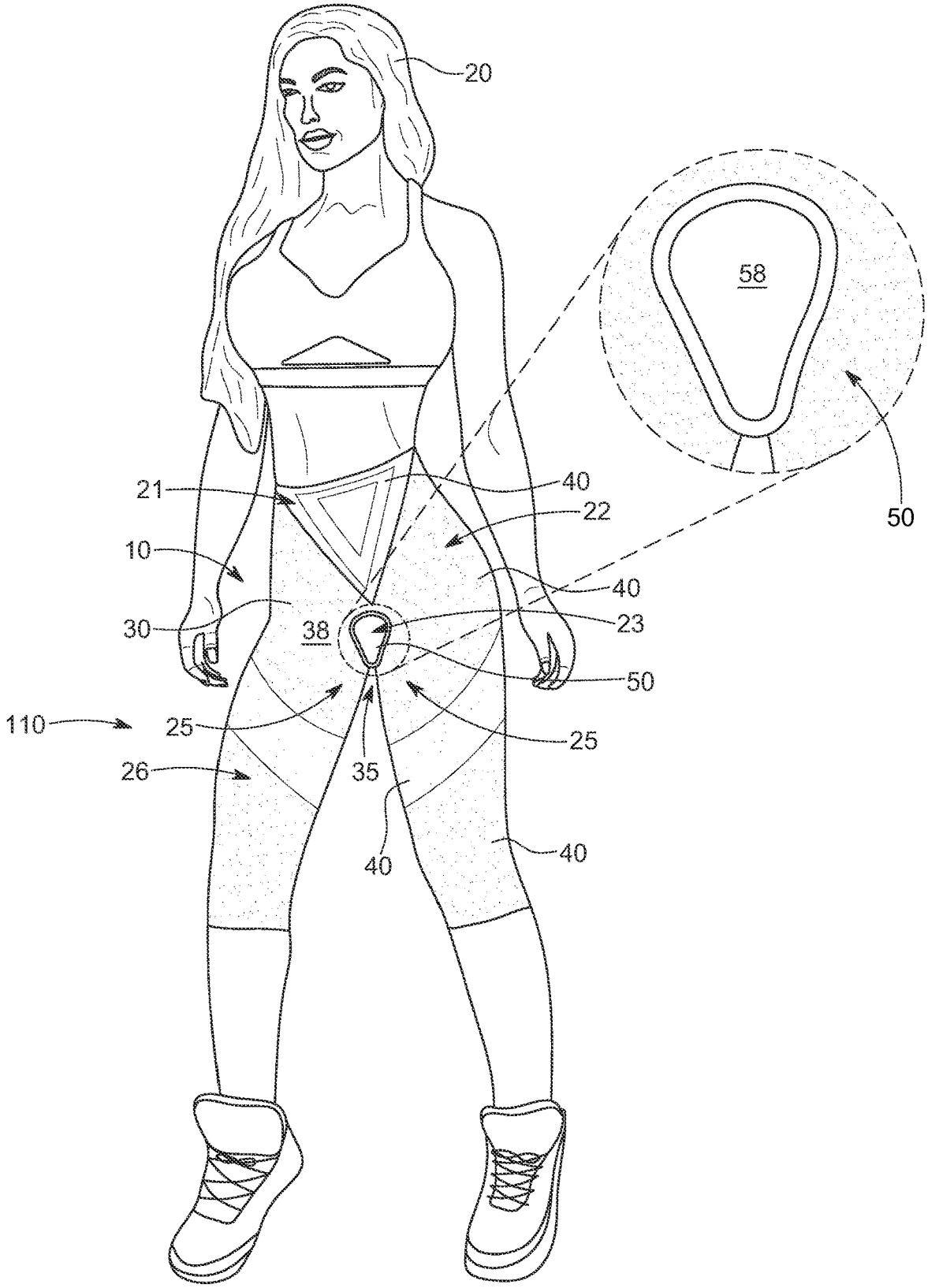
FIG. 1 is a front perspective view of one embodiment of the invention, illustrated without an exterior layer for clarity of illustration.
Figure 2:
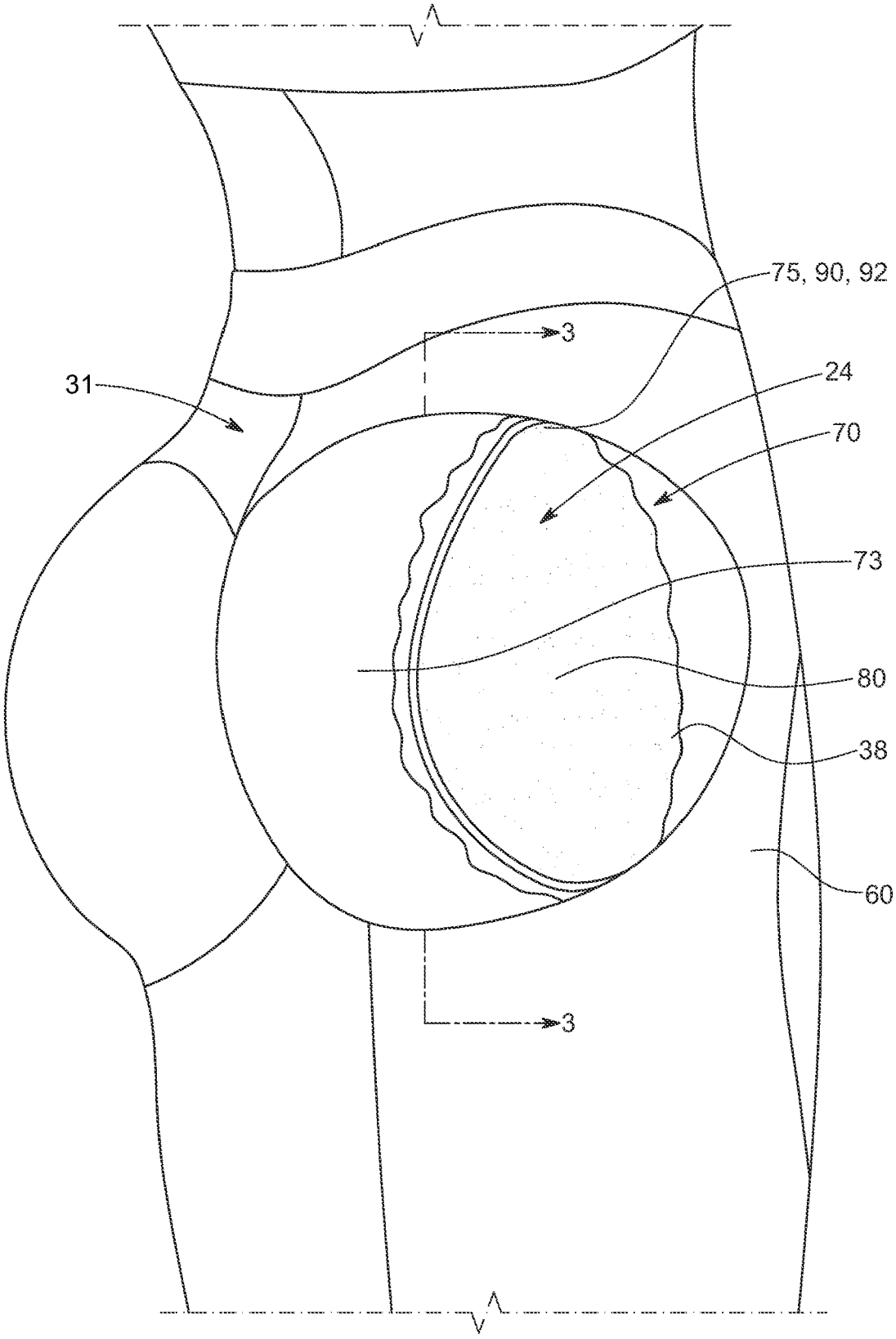
FIG. 2 is a partial rear perspective view of the invention, partially broken away to reveal a shaped insert.
Figure 3:
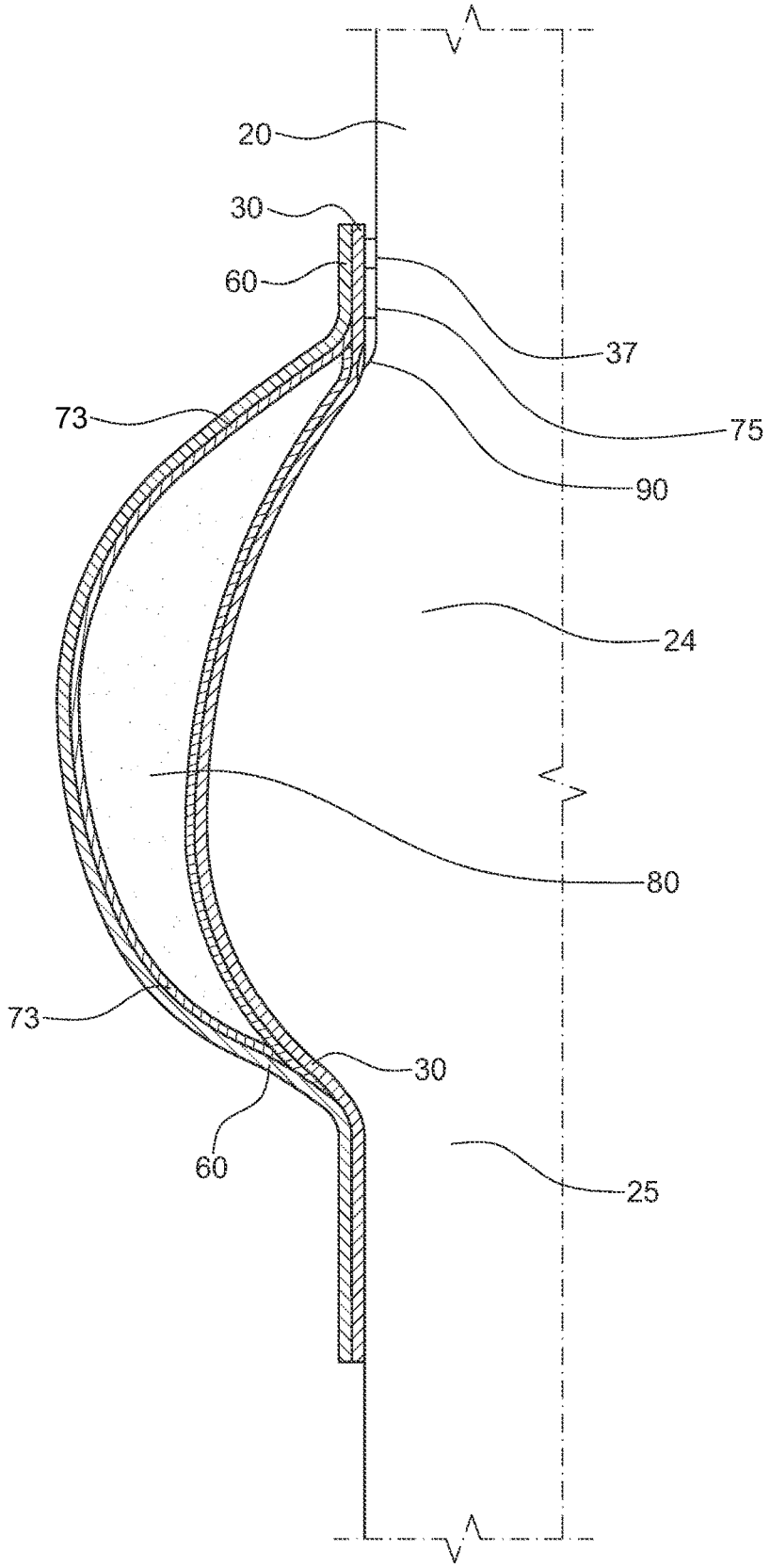
FIG. 3 is a cross-sectional view thereof, taken along line 3-3 of FIG. 2.
Figure 4:
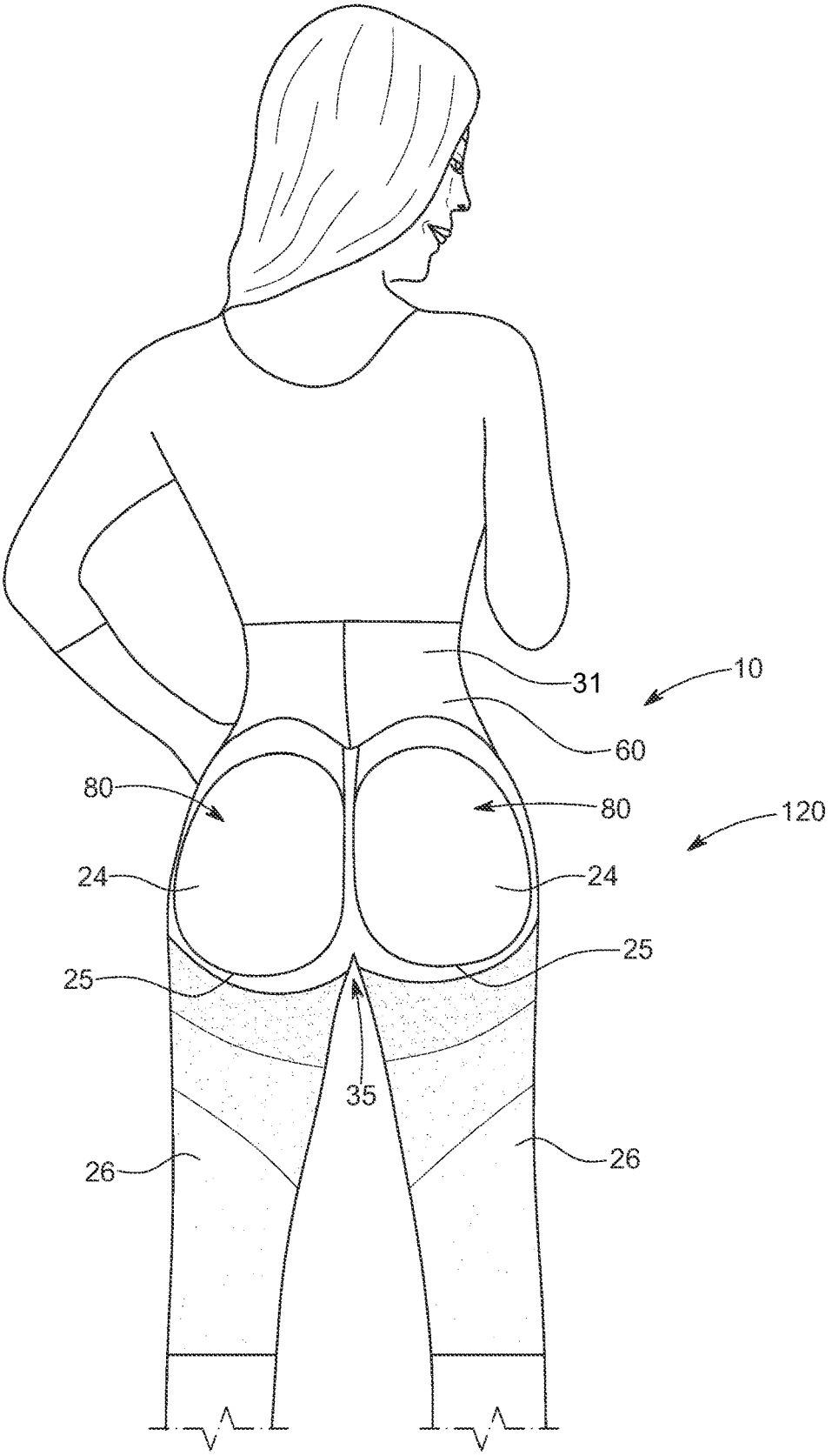
FIG. 4 is a rear elevational view of another embodiment of the invention.
Figure 5:
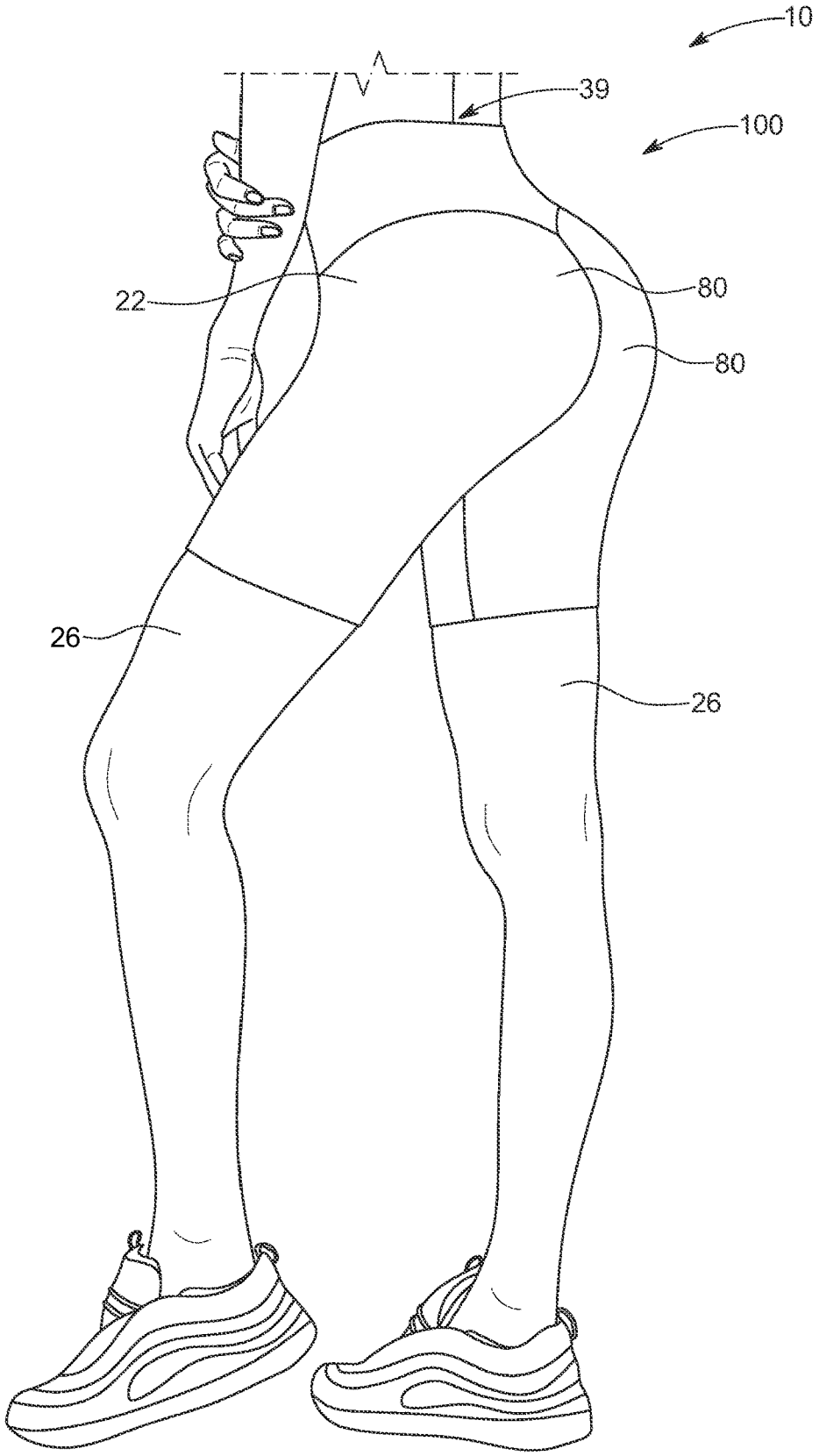
FIG. 5 is a rear perspective view of yet another embodiment of the invention.
Figure 6:
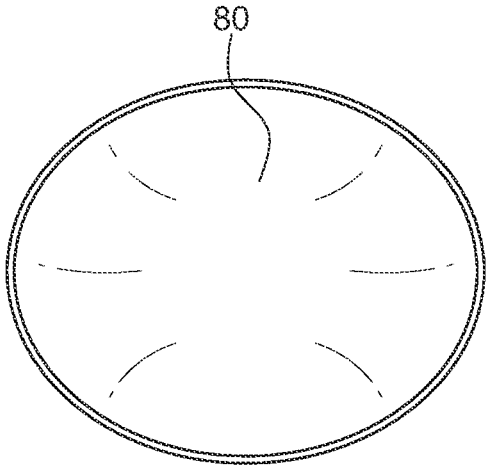
FIG. 6 is a rear elevational view of the shaped insert of the invention.
Figure 7:
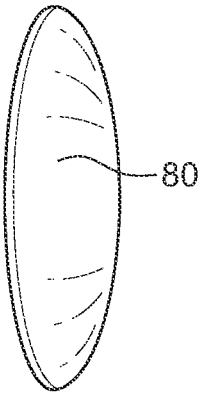
FIG. 7 is a rear perspective view of the shaped insert of the invention.

FIGS. 1-3 illustrate a lower garment 10 for a female person 20. The lower garment 10 may take the form of, for example, shorts, leggings, capris, jeans, biker shorts, sweat pants, tights, or any other suitable lower garment 10.

An interior layer 30 comprises one or more elastic fabric panels 40 encircling the person's waist 22 and at least a portion of the person's stomach 21 at a top end 39 of the interior layer 30. The interior layer 30 extends downward to at least the top of the person's upper thighs 25 around the person's legs 26. The interior layer 30 has an inside surface 32 for contacting the person's skin, and an outside surface 38. Preferably each elastic fabric panel 40 of the interior layer 30 includes materials taken from the group comprising nylon, spandex, and micro-compression breathable fabric. In some embodiments, the interior layer 30 is colored between a light brown color and a dark brown color.

A resilient crotch insert 50 extends from an inseam 35 of the interior layer 30 forward to substantially cover the person's labia 23. The crotch insert 50 is adapted to present a smooth front surface 58 that does not conform to the shape of the person's labia 23. Preferably the crotch insert 50 includes a plurality of layers 55 of resilient padding, nylon or spandex fabric layers, and/or other materials that is thick enough in a central portion to avoid conforming to the shape of the person's labia 23, yet still thin enough, particularly around the edges of the crotch insert 50, to not appear like a bulky menstrual pad or result in edge lines. The crotch insert 50 is preferably in the shape of a feminine pad or similar so that the entire labial 23 is covered thereby, yet thin in the inseam for comfort and to avoid chaffing of the legs 26 and upper thighs 25 while walking. Notably, the lower garment 10 does not require a standard inseam gusset, often used in prior art garments, adding to a smooth and seamless appearance.

An exterior layer 60 is applied to the outside surface 38 of the interior layer 30 and the front surface 58 of the crotch insert 50. The exterior layer 60 is preferably integrally formed without seams in preferred embodiments. Preferably the exterior layer 60 includes materials taken from the group comprising spandex, polyester, rayon, cotton, denim, a mixture thereof, or other like materials as is known in the art for lower garments. In some embodiments, the exterior layer 60 is colored between a light brown color and a dark brown color for blending in should another garment be worn over the lower garment 10. The exterior layer 60 is applied to the interior layer 30 with adhesives, sewing, ultrasonic bonding, or other methods as are known in the art. Together the exterior layer 60 presents a seamless or minimally-seamed garment outwardly, obscuring any seams that may be present with the interior layer 30.

Preferably the interior layer 30 and the exterior layer 60 together are adapted to compress the person's thighs 25 and to lift and support the person's buttocks 24. In some embodiments the interior layer 30 and the exterior layer 60 together are adapted to lift and support at least the portion of the person's stomach 21.

In some embodiments a high-friction strip 37 (FIG. 3) is disposed around the inside surface 32 of the interior layer 30 proximate the top end 38 of the interior layer 30. As such, the high-friction strip 37 inhibits slipping of the lower garment 10 on the person's waist 22. Such a high-friction strip 37 may be a thin strip of a silicon rubber material, for example.

In some embodiments the interior layer 30 extends to at least the person's mid-thighs 27 down each of the person's legs 26. The interior layer 30 extending down each leg 26 is preferably made of a single seamless fabric panel 40 to avoid unsightly seams.

Figure 8:
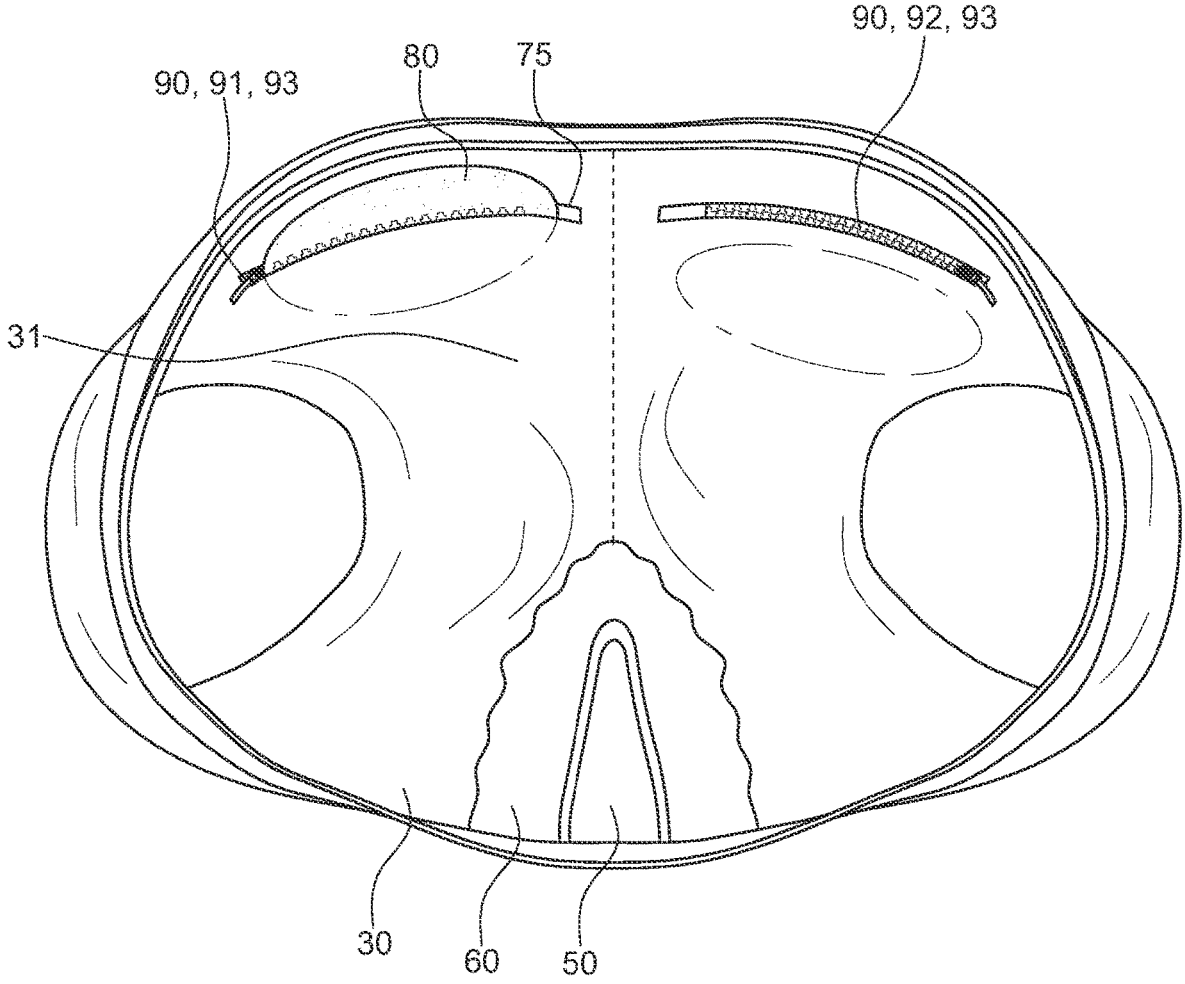
FIG. 8 is a top plan view of still yet another embodiment of the invention.

In preferred embodiments of the invention, the interior layer 30 includes two buttocks pocket openings 75 (FIGS. 2, 3 and 8) through the interior layer 30 proximate the top end 38 of the interior layer 30 at a back side 31 thereof. Each pocket opening 75 defines a buttocks pocket 70 adapted for receiving a shaping insert 80 (FIGS. 3 and 6-8) between the interior layer 30 and a pocket panel 73. The shaped insert 80 extends downward to cover at least a portion of the person's buttocks 24, and preferably includes a foam or silicon material adapted to retain its shape but still be resilient.

In such embodiments, each pocket opening 75 preferably includes a closure 90 on the inside surface 32 of the interior garment 30. Each closure 90 has an open configuration 91 and a closed configuration 92, such that the shaping insert 80 is inhibited from slipping within the buttocks pocket 70 when the closure 90 is in the closed configuration 92. Such a closure 90 may include a zipper, hook-and-loop type fastening material, mechanical fasteners such as snaps and buttons, or the like. Preferably, however, the closure 90 is relatively flat when in the closed configuration 91 so that little or no outline of the closure 90 is visible through the internal layer 30 and the external layer 60 of the lower garment 10.

While a particular form of the invention has been illustrated and described, it will be apparent that various modifications can be made without departing from the spirit and scope of the invention. For example, the lower garment 10 may take the form of other garments (not shown), such as bikini bottoms, jeggings, etc. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A lower garment for a female person, comprising:

an interior layer comprising one or more elastic fabric panels encircle the person's waist and at least a portion of the person's stomach at a top end of the interior layer, the interior layer extending downward to at least the top of the person's upper thighs around the person's legs, the interior layer having an inside surface for contacting the person's skin, and an outside surface;

a resilient crotch insert extending from an inseam of the interior layer forward to substantially cover the person's labia, the crotch insert adapted to present a smooth front surface that does not conform to the shape of the person's labia;

an exterior layer applied to the outside surface of the interior layer and the front surface of the crotch insert, the exterior layer integrally formed without seams.

2. The lower garment of claim 1 wherein the interior layer and the exterior layer together are adapted to compress the person's thighs to lift and support the person's buttocks.

3. The lower garment of claim 1 wherein the interior layer and the exterior layer together are adapted to lift and support at least the portion of the person's stomach.

4. The lower garment of claim 1 wherein the interior layer extends to at least the person's mid-thighs down each of the person's legs, the interior layer extending down each leg made of a single seamless fabric panel.

5. The lower garment of claim 1 wherein the elastic fabric panels of the interior layer include materials taken from the group comprising nylon, spandex, and micro-compression breathable fabric.

6. The lower garment of claim 1 wherein the interior layer includes two buttocks pocket openings through the interior layer proximate the top end of the interior layer at a back side thereof, each pocket opening defining a buttocks pocket adapted for receiving a shaping insert between the interior layer and a pocket panel fixed with the interior layer, the shaped insert extending downward to cover at least a portion of the person's buttocks.

7. The lower garment of claim 6 wherein each pocket opening includes a closure on the inside surface of the interior garment, the closure having an open configuration and a closed configuration, whereby the shaping insert is inhibited from slipping within the buttocks pocket when the closure is in the closed configuration.

8. The lower garment of claim 6 wherein the closure includes a zipper.

9. The lower garment of claim 6 wherein each shaping insert includes a foam material.

10. The lower garment of claim 6 wherein each shaping insert includes a silicon material.

11. The lower garment of claim 1 wherein the interior layer and the exterior layer are colored between a light brown color and a dark brown color.

12. The lower garment of claim 1 wherein the exterior layer includes materials taken from the group comprising spandex, polyester, rayon, cotton, or a mixture thereof.

13. The lower garment of claim 1 further including a high-friction strip disposed around the inside surface of the interior layer proximate the top end of the interior layer, whereby the high-friction strip inhibits slipping of the lower garment on the person's waist.

14. A lower garment for a female person, comprising:

an interior layer comprising one or more elastic fabric panels encircle the person's waist and at least a portion of the person's stomach at a top end of the interior layer, the interior layer extending downward to at least the top of the person's upper thighs around the person's legs, the interior layer having an inside surface for contacting the person's skin, and an outside surface, the elastic fabric panels of the interior layer including materials taken from the group comprising nylon, spandex, and micro-compression breathable fabric;

a resilient crotch insert extending from an inseam of the interior layer forward to substantially cover the person's labia, the crotch insert adapted to present a smooth front surface that does not conform to the shape of the person's labia;

an exterior layer comprising one or more panels applied to the outside surface of the interior layer and the front surface of the crotch insert, the exterior layer integrally formed without seams, the exterior layer including materials taken from the group comprising spandex, polyester, rayon, cotton, or a mixture thereof, the interior layer and the exterior layer colored between a light brown color and a dark brown color;

the interior layer and the exterior layer together being adapted to compress the person's thighs to lift and support the person's buttocks, and to lift and support at least the portion of the person's stomach;

two buttocks pocket openings formed through the interior layer proximate the top end of the interior layer at a back side thereof, each pocket opening defining a buttocks pocket adapted for receiving a shaping insert between the interior layer and a pocket panel fixed with the interior layer, the shaped insert extending downward to cover at least a portion of the person's buttocks, each pocket opening including a zipper closure on the inside surface of the interior garment, the zipper closure having an open configuration and a closed configuration, the shaping insert being inhibited from slipping within the buttocks pocket when the zipper closure is in the closed configuration.

15. The lower garment of claim 14 wherein each shaping insert includes a foam material.

16. The lower garment of claim 14 wherein each shaping insert includes a silicon material.

17. The lower garment of claim 14 wherein the lower garment takes the form of shorts.

18. The lower garment of claim 14 wherein the interior layer extends to at least the person's mid-thighs down each of the person's legs, the interior layer extending down each leg made of a single seamless fabric panel.

19. The lower garment of claim 14 further including a high-friction strip disposed around the inside surface of the interior layer proximate the top end of the interior layer, whereby the high-friction strip inhibits slipping of the lower garment on the person's waist.

* * * * *